US011643883B1

(12) United States Patent
Hardin et al.

(10) Patent No.: US 11,643,883 B1
(45) Date of Patent: May 9, 2023

(54) ADJUSTABLE FLEX SYSTEM FOR DIRECTIONAL DRILLING

(71) Applicant: Halliburton Energy Services, Inc., Houston, TX (US)

(72) Inventors: John R. Hardin, Houston, TX (US); Timothy Edward Harms, Carrollton, TX (US); Robert Travis Murphy, Carrollton, TX (US); Adnan Zaman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/569,635

(22) Filed: Jan. 6, 2022

(51) Int. Cl.
*E21B 17/20* (2006.01)
*E21B 7/06* (2006.01)

(52) U.S. Cl.
CPC ..... *E21B 17/20* (2013.01); *E21B 7/067* (2013.01)

(58) Field of Classification Search
CPC ..... E21B 17/20; E21B 7/067
See application file for complete search history.

(56) References Cited

U.S. PATENT DOCUMENTS 3,011,568 A * 12/1961 Grimm ..... E21B 7/061 166/117.6
7,779,934 B1 8/2010 Driver
9,803,426 B2 10/2017 Menger et al.
10,787,866 B2 * 9/2020 Thomas ..... E21B 23/14
11,035,174 B2 * 6/2021 Hardin, Jr. ..... E21B 7/06
11,421,480 B2 * 8/2022 Peters ..... E21B 7/06
2001/0052427 A1 * 12/2001 Eppink ..... E21B 7/068 175/263
2003/0010534 A1 1/2003 Chen et al.
2006/0283635 A1 12/2006 Moody et al.
2007/0163810 A1 * 7/2007 Underwood ..... E21B 7/04 175/73
2012/0205117 A1 8/2012 Harms
2015/0368975 A1 * 12/2015 Zu ..... E21B 7/067 175/76
2016/0123093 A1 5/2016 Richards et al.
2016/0153248 A1 6/2016 Richards et al.
2016/0258218 A1 * 9/2016 Lange ..... E21B 17/20
2017/0370152 A1 12/2017 Samuel et al.
2020/0217146 A1 7/2020 Armstrong et al.

OTHER PUBLICATIONS

International Search Report and Written Opinion for Application No. PCT/US2022/012803, dated Oct. 4, 2022.

* cited by examiner

*Primary Examiner* — Taras P Bemko
(74) *Attorney, Agent, or Firm* — Benjamin Ford; C. Tumey Law Group PLLC

(57) ABSTRACT

A system for an adjustably flexible downhole tool includes first and second connector ends each configured to connect to adjacent downhole tools and a shaft extending between the first and second connector ends. The shaft is configured to bend in response to passing through curved portions of a wellbore. The adjustably flexible downhole tool also includes an outer sleeve disposed around at least a portion of the shaft and extending from the first connector end in a direction toward the second connector end and at least one adjustable member configured to move axially, with respect to the shaft, from a first position to a second position to increase bending stiffness and/or torsional stiffness of the adjustably flexible downhole tool. The at least one adjustable member at least partially restrains bending of the shaft in the second position.

20 Claims, 7 Drawing Sheets

ADJUSTABLE FLEX SYSTEM FOR DIRECTIONAL DRILLING

BACKGROUND

Generally, wellbores are drilled through hydrocarbon-bearing subsurface formations to obtain hydrocarbons such as oil and gas. Some wellbores include vertical portions, as well as horizontal/lateral portions. Indeed, a wellbore may extend vertically downward from a surface of the drilling operation and transition, via a curved portion (e.g., dogleg portion), to a horizontal portion at a desired depth in the subsurface formation. During drilling operations, a rotary steerable system tool may be implemented in a downhole drilling operation to guide a drilling path of the bottom hole assembly (BHA). The rotary steerable system may veer the BHA from a vertical drilling path to a horizontal drilling path. For some subsurface formations, a curved portion having a high dogleg severity may be desirable. As such, some rotary steerable systems may include a flexible tool such that the rotary steerable system may increase a dogleg severity (i.e., a measure of the change in direction of a wellbore over a defined length) of the curved portion of the wellbore.

Unfortunately, the flexible tool may hinder drilling operations in straight portions of the wellbore (e.g., the vertical portion and/or horizontal portion). In particular, the flexible tool may have decreased torsional stiffness making the BHA less suitable for steering controllability and vibration mitigation, which may lead to an increased risk of stick-slip, whirl, and/or other issues.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for an adjustably flexible downhole tool. In particular, a bottom hole assembly comprises the adjustably flexible downhole tool, as well as a rotary steerable system for steering the bottom hole assembly (BHA) assembly during drilling operations. As set forth in detail below, the adjustably flexible downhole tool may have at least one adjustable member configured to adjust a stiffness of the adjustably flexible downhole tool as the BHA moves along the wellbore. For example, the adjustably flexible downhole tool may be adjusted to be more flexible for curved portions (e.g., dogleg portions) such that the rotary steerable system may increase a dogleg severity (i.e., a measure of the change in direction of a wellbore over a defined length) of the curved portion of the wellbore. Further, the adjustably flexible downhole tool may be adjusted to be stiffer along straight portions of the wellbore for improved steering controllability, vibration mitigation, and/or other benefits.

Figure 1:
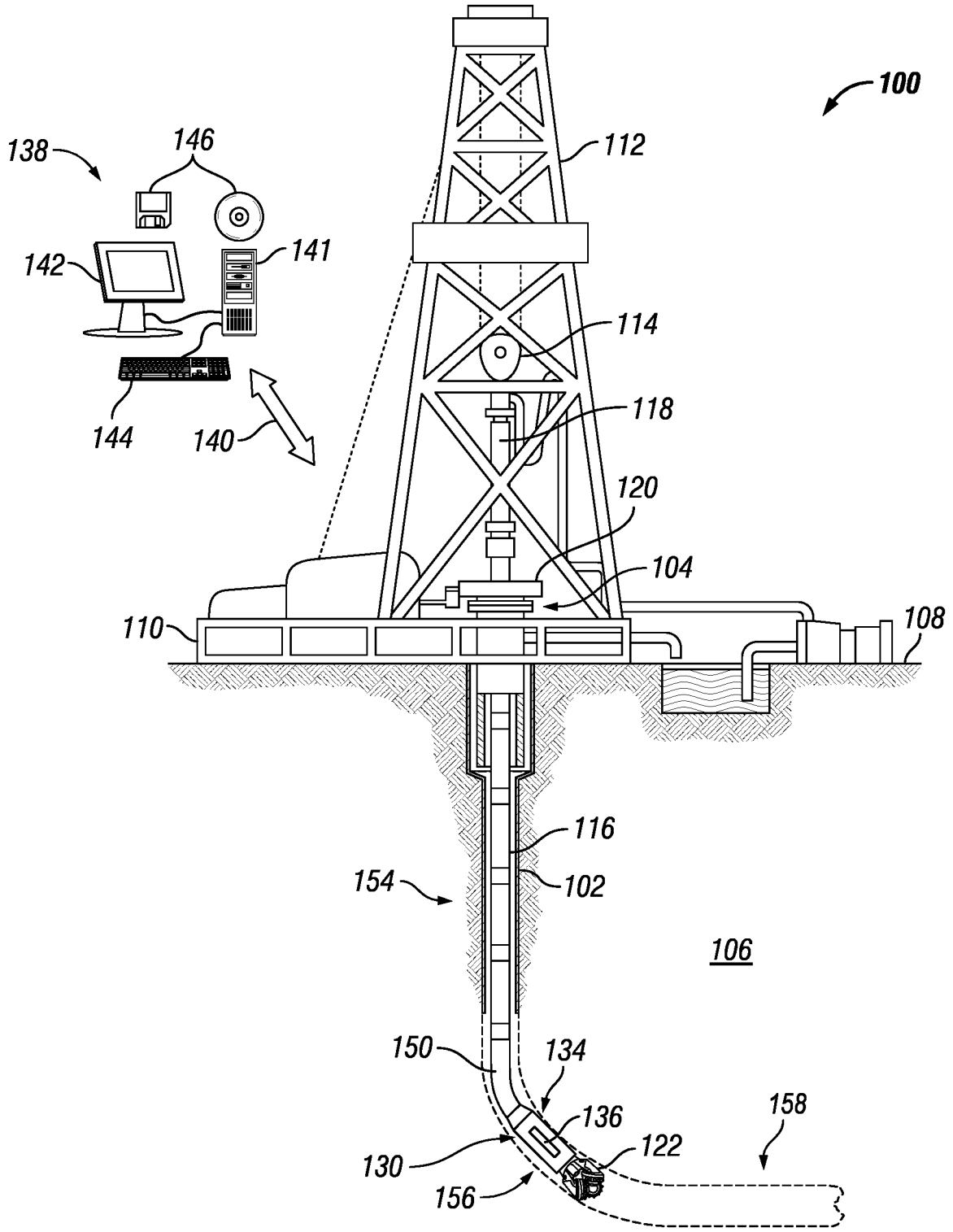
FIG. 1 illustrates a downhole drilling system, in accordance with some embodiments of the present disclosure.

FIG. 1 illustrates a downhole drilling system 100, in accordance with some embodiments of the present disclosure. As illustrated, a drilling platform 110 may support a derrick 112 having a traveling block 114 for raising and lowering drill string 116. The drill string 116 may comprise, but is not limited to, drill pipe and coiled tubing, as generally known to those skilled in the art. A kelly 118 may support drill string 116 as it may be lowered through a rotary table 120. A top drive system may be used in place of a kelly. A bottom hole assembly 134 having a drill bit 122 may be attached to the distal end of the drill string 116 and may be driven either by a downhole motor and/or via rotation of the drill string 116 from surface 108. Without limitation, the drill bit 122 may comprise, roller cone bits, polycrystalline diamond compact (PDC) bits, natural diamond bits, any hole openers, reamers, coring bits, and the like. As the drill bit 122 rotates, it may form a wellbore 102 along a drilling path of the drill bit 122. The wellbore 102 may extend from a wellhead 104 into a subterranean formation 106 from the surface 108. As illustrated, the wellbore 102 may comprise a vertical portion 154, a curved portion 156, and a horizontal portion 158. However, in some embodiments, the wellbore 102 may comprise portions with other orientations (e.g., a slanted portion).

A rotary steerable system 130 of the bottom hole assembly 134 may be configured to steer the drill bit 122 through the subterranean formation 106 to form the various portions of the wellbore 102. The bottom hole assembly 134 may further comprise an adjustably flexible downhole tool 150 configured to support the rotary steerable system 130 in steering the drill bit 122. For example, the adjustably flexible downhole tool 150 may be adjusted to be more flexible while drilling the curved portion(s) 156 and may be adjusted to be stiffer while drilling straight portions (e.g., the vertical portion 154, the horizontal portion 158, etc.). Moreover, the rotary steerable system 130 may comprise any number of tools, such as sensors 136, transmitters, and/or receivers to perform downhole measurement operations or to perform real-time health assessment of a rotary steerable system 130 during drilling operations. Further, the rotary steerable system 130 may comprise any number of different measurement assemblies, communication assemblies, battery assemblies, and/or the like. Moreover, the sensors 136 may be connected to information handling system 138. There may be any number of sensors 136 disposed in the BHA 134 or rotary steerable system 130.

Moreover, the rotary steerable system 130 may be connected to and/or controlled by information handling system 138, which may be disposed on surface 108 or downhole in the rotary steerable system 130. A communication link 140 may provide transmission of measurements from the sensors 136 to the information handling system 138, as well as commands from the information handling system 138 to the rotary steerable system 130. The communication link 140 may include, but is not limited to, wired pipe telemetry, mud-pulse telemetry, acoustic telemetry, and electromagnetic telemetry. Further, the information handling system 138 may comprise a personal computer 141, a video display 142, a keyboard 144 or any suitable input device, and/or non-transitory computer-readable media 146 (e.g., optical disks, magnetic disks) that can store code representative of the methods described herein.

Figure 2A:
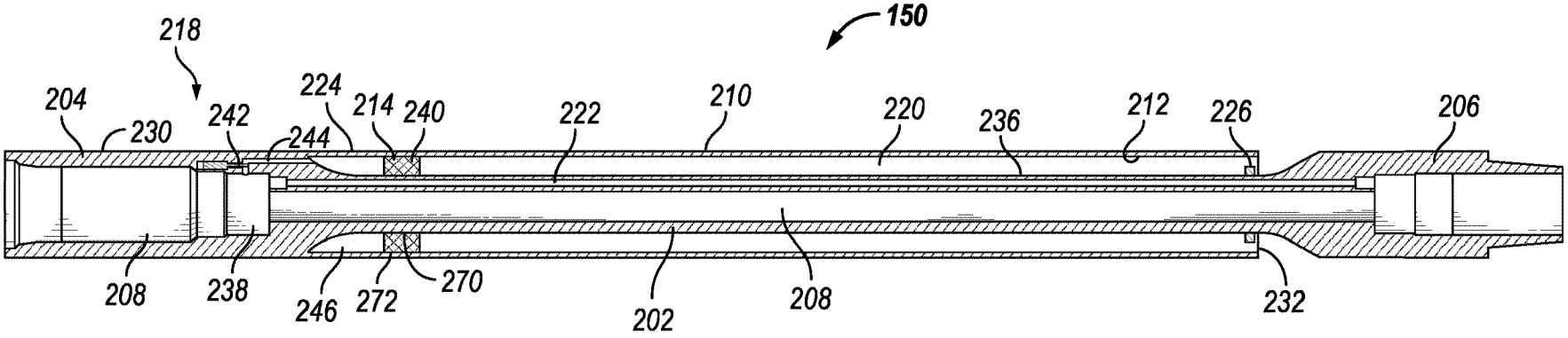
FIGS. 2A-2D illustrate cross-sectional views of an adjustably flexible downhole tool having an annular piston, in accordance with some embodiments of the present disclosure.
Figure 2B:
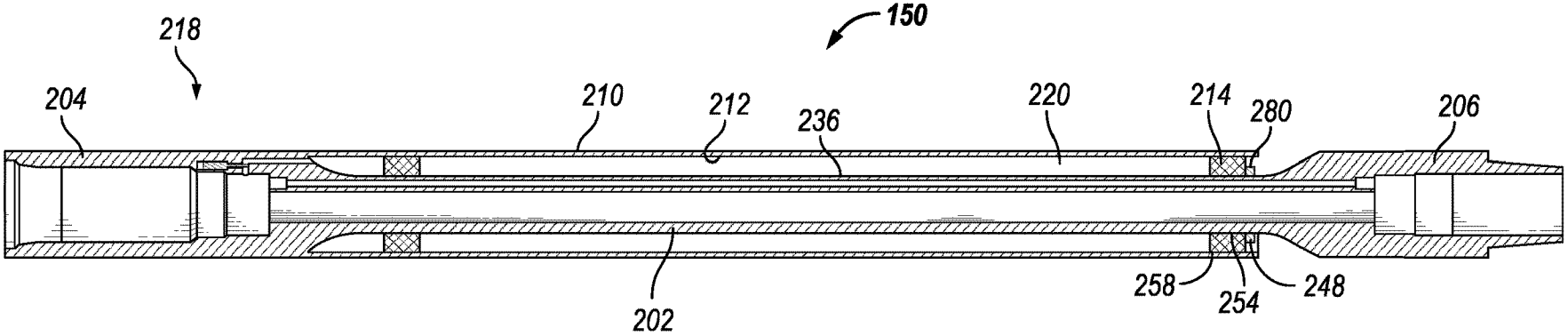

FIGS. 2A-2D illustrate cross-sectional views of an adjustably flexible downhole tool having an annular piston, in accordance with some embodiments of the present disclosure. In particular, FIG. 2A illustrates the annular piston disposed in the first position and FIG. 2B illustrates the annular piston disposed in the second position. With regard to FIG. 2A, the adjustably flexible downhole tool 150 may comprise a shaft 202 extending between a first connector end 204 and a second connector end 206. The shaft 202 may be rigidly secured to the first connector end 204 and the second connector end 206 via a unibody construction, a threaded connection, and/or at least one fastener. Further, the shaft 202 may have a substantially cylindrical shape with a central bore 208 extending through the shaft 202 along a central axis of the shaft. However, in some embodiments, the central bore 208 may also be offset eccentrically from the central axis of the shaft. During drilling operations, the central bore 208 may provide a fluid passageway for drilling fluid to pass through the adjustably flexible downhole tool 150 to other portions of the BHA 134 disposed downhole of the adjustably flexible downhole tool 150. Moreover, the shaft 202 may comprise one or more secondary bores 222 extending through the shaft 202 and configured to house wiring and/or other communication mediums.

The adjustably flexible downhole tool 150 may also comprise an outer sleeve 210 disposed around at least a portion of the length of shaft 202. The outer sleeve 210 may be annular such that the outer sleeve radially encloses the shaft 202. In some embodiments, the outer sleeve 210 may comprise radial slots, gaps, or other spaces such that the outer sleeve 210 only partially encloses the shaft 202. Moreover, as illustrated, an anchored end 224 of the outer sleeve 210 may be connected to the first connector end 204, and the outer sleeve 210 may extend axially from the first connector end 204 in a direction toward the second connector end 206. A free end 226 of the outer sleeve 210, opposite the anchored end 224, may be disposed proximate the second connector end 206. In the illustrated embodiment, the free end 226 is not attached to the second connector end 206. That is, the outer sleeve 210 may be cantilevered from the first connector end 204. Moreover, the outer sleeve 210 may be secured to the first connector end 204 via a threaded connection, welding, fasteners (e.g., screws, pins, etc.), and/or press-fitting a radially inner sleeve surface 212 of the outer sleeve against a radially outer connector surface 230 of the first connector end 204.

The radially inner sleeve surface 212 of the outer sleeve 210 may be radially offset from a radially outer shaft surface 236 of the shaft 202 such that an annulus 220 is formed between the outer sleeve 210 and the shaft 202. At least one adjustable member 240 may be disposed in the annulus 220 defined between the shaft 202 and the outer sleeve 210. As illustrated, the at least one adjustable member 240 comprises an annular piston 214 configured to move axially with respect to outer sleeve 210 and shaft 202. In the illustrated embodiment, the annular piston 214 is disposed in a first position located proximate the first connector end 204. However, the annular piston 214 may be configured to move axially along the shaft 202 from the first position to the second position located proximate the free end 226 of the outer sleeve and/or the second connector end 206. Moving the annular piston 214 from the first position toward the second position may increase bending stiffness and/or torsional stiffness of the adjustably flexible downhole tool.

A radially inner piston surface 270 of the annular piston 214 may be configured to interface with the radially outer shaft surface 236 of the shaft 202, and a radially outer piston surface 272 of the annular piston may be configured to interface with the radially inner sleeve surface 212 of the outer sleeve 210. As such, the annular piston 214 may at least partially restrain radial movement (e.g., deflection/bending) of the shaft 202 with respect to the outer sleeve 210 at a location of the annular piston 214. During drilling operations, the adjustably flexible downhole tool 150 may experience forces in certain locations along the wellbore (e.g., the curved portion 156) that cause the adjustably flexible downhole tool 150 to bend. In particular, as the shaft 202 is connected at both ends (e.g., to the first connector end 204 and the second connector end 206), the shaft 202 may bend due to the forces present along the curved portion 156. Generally, as the outer sleeve 210 is cantilevered from the first connector end 204, the outer sleeve may not support the shaft 202. However, as the annular piston 214 is configured to interface with both the shaft 202 and the outer sleeve 210, the outer sleeve 210 may support the shaft 202 (e.g., to restrain bending) at the location of the annular piston 214.

In the illustrated embodiment, the annular piston 214 is disposed in the first position. As the first position is disposed proximate the first connector end 204, only a portion of the outer sleeve 210 (e.g., between the first connector end 204 and the annular piston 214) is configured to help restrain radial movement (e.g., bending) of the shaft 202. However, as the annular piston 214 moves toward the second connector end 206, more of the length of the outer sleeve 210 may be configured to support more of the length of the shaft 202, which is configured to increase the bending stiffness of the adjustably flexible downhole tool 150. As such, the adjustably flexible downhole tool 150 may be adjusted between a flexible state (e.g., with the annular piston 214 in the first position) and a stiffer state (e.g., with the annular piston 214 in the second position). In some embodiments, the stiffness of the adjustably flexible downhole tool 150 may be variable adjusted. That is, the annular piston 214 may be positioned at any axial position along the shaft 202 between the first position and the second position to provide additional stiffness control for the adjustably flexible downhole tool 150. For example, the adjustably flexible downhole tool 150 may move through a curved portion 156 of the wellbore 102 that has a low dogleg severity. To maintain higher steering controllability and/or vibration mitigation while still increasing the flexibility of the adjustably flexible downhole tool 150 to reduce strain, the annular piston 214 may be moved to a position disposed between the first position and the second position.

An actuator 218 may be configured to drive the adjustable member 240 (e.g., annular piston 214) along the shaft 202 between the first position and the second position. In some embodiments, the actuator 218 may be configured to provide unidirectional movement of the annular piston 214 (e.g., in a direction from the first connector end 204 toward the second connector end 206). However, in some embodiments, the actuator 218 may be configured to provide bidirectional movement of the annular piston 214 along the shaft 202. Further, the actuator 218 may be configured to drive the adjustable member 240 on demand. That is, the actuator 218 may be configured to receive signal, via electrical communication, fluid communication, or any other suitable communication mechanism, and drive the adjustable member 240 in response to receiving the signal. In the illustrated embodiment, the actuator 218 comprises a hydraulic system 238 having at least a control valve 242 and a fluid passageway 244 extending from the central bore 208 to a sealed chamber 246. The sealed chamber 246 may be defined by a portion of the annulus 220 between the first connector end 204 and the annular piston 214. In some embodiments, to help isolate the sealed chamber 246 from the downhole environment, the annular piston 214 may comprise a plurality of seals to form a seal between the annular piston 214 and the shaft 202, as well as between the annular piston 214 and the outer sleeve 210.

Moreover, to move the annular piston 214 in the direction from the first position toward the second position, the control valve 242 may be configured to open the fluid passageway 244 in response to a control signal; thereby, permitting fluid from the central bore 208 to pass through the fluid passageway 244 and enter the sealed chamber 246. As the fluid enters the sealed chamber 246, the pressure in the sealed chamber 246 may increase. In response to the pressure in the sealed chamber 246 exceeding a threshold pressure, the annular piston 214 may move in the direction toward the second connector end 206. Further, the actuator 218 may comprise an electrical motor, or any other suitable actuator or combination of actuators, to move the annular piston 214 between the first position and the second position.

Further, the adjustably flexible downhole tool 150 may also comprise a debris barrier 232 configured to prevent downhole debris from moving into the annulus 220. For example, the debris barrier 232 may comprise a screen to filter out debris moving into the annulus 220. The debris barrier 232 may be secured in the annulus 220 in a location proximate the second connector end 206. In particular, the debris barrier 232 may be disposed between the second position of the annular piston 214 and the second connector end 206 such that the debris barrier 232 does not inhibit movement of the annular piston 214 along the annulus 220 between the first position and the second position. Moreover, the debris barrier 232 may span between the shaft 202 and the outer sleeve 210.

With regard to FIG. 2B, the adjustably flexible downhole tool 150 comprises the annular piston 214 disposed in the second position. As set forth above, the actuator 218 may be configured to move the annular piston 214 axially along the shaft 202 between the first position (shown in FIG. 2A) and the second position. In some embodiments, the adjustably flexible downhole tool 150 may comprise a stop mechanism 280 configured to restrain axial movement of the annular piston 214 at the second position in at least the direction toward the second connector end 206. For example, the stop mechanism 280 may comprise an annular stop ring 248 rigidly secured to the radially outer shaft surface 236 and/or the radially inner sleeve surface 212 in a position proximate the second position such that the annular stop ring 248 may contact the annular piston 214 to stop movement of the annular piston 214 at the second position. In the illustrated embodiment, the annular stop ring 248 is rigidly secured to the radially inner sleeve surface 212 proximate the second position of the annular piston 214.

Alternatively, the stop mechanism 280 may comprise a wedge disposed proximate the second position. For example, the shaft 202 may comprise a wedge protruding into the annulus 220 from the radially outer shaft surface 236. Alternatively, the diameter of the shaft 202 may gradually increase along the length of the shaft 202 in the direction toward the second connector end 206, starting from the second position, to form the wedge (e.g., tapered surface). The wedge may be configured to restrain axial movement of the annular piston 214 in the direction toward the second connector end 206 and/or secure the annular piston 214 at the second position. Likewise, the outer sleeve 210 may comprise a wedge (e.g., tapered surface) protruding into the annulus 220 from the radially inner sleeve surface 212. In addition, the annular piston 214 may have a tapered portion. In particular, the radially inner piston surface 270 and/or radially outer piston surface 272 may comprise tapered portions. As the annular piston 214 moves into the second position, the tapered portion of radially inner piston surface 270 may engage the wedge of shaft 202 and the tapered portion of radially outer piston surface 272 may engage the wedge of outer sleeve 210. The engagement of both tapered portions may create a more rigid coupling of shaft 202 to outer sleeve 210 through annular piston 214 at the second position. Indeed, removing the radial clearance between shaft 202, annular piston 214, and outer sleeve 210 may make the adjustably flexible downhole tool 150 more laterally stiff and less prone to wear from relative movement of parts in abrasive drilling mud during drilling operations. Further, the rigid coupling of shaft 202 to outer sleeve 210 through annular piston 214 at the second position may increase the torsional stiffness of the adjustably flexible downhole tool 150.

Figure 2D:
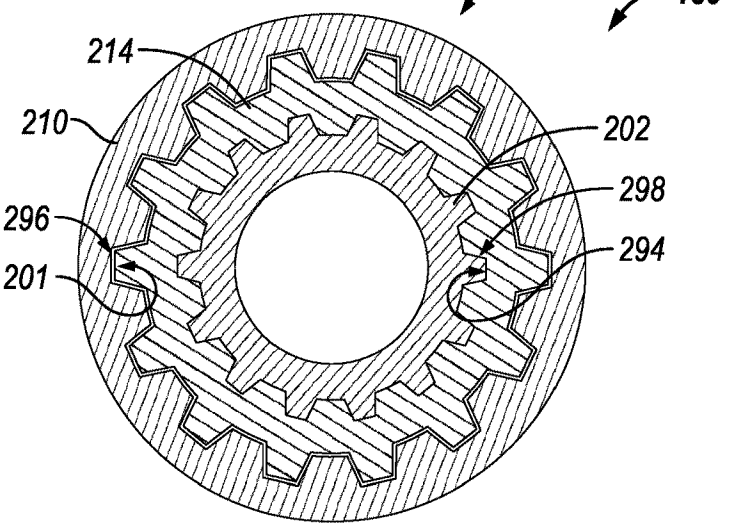
Figure 2C:
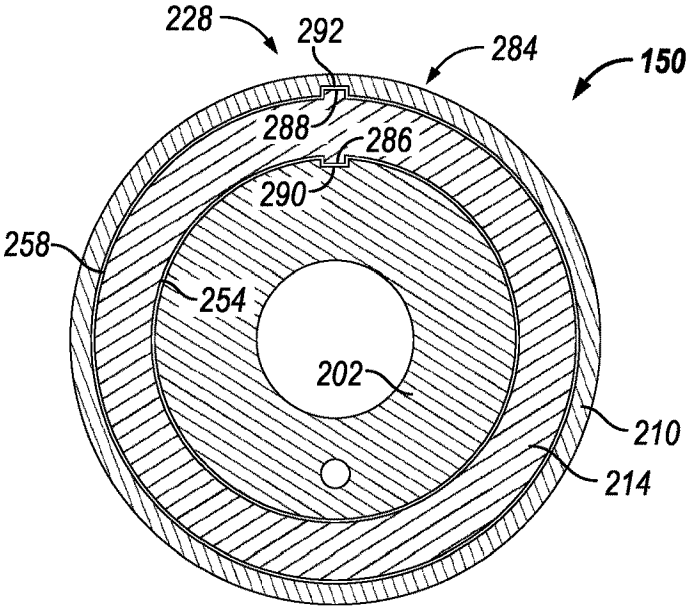

With regard to FIG. 2C, the adjustably flexible downhole tool 150 may further comprise a torsional stiffener mechanism 284 configured to increase the torsional stiffness of the adjustably flexible downhole tool 150 as the annular piston 214 moves toward the second position. The torsional stiffener mechanism 284 may be configured to restrain rotational movement of the annular piston 214 with respect to the shaft 202, as well as rotational movement of the annular piston 214 with respect to the outer sleeve 210, at the location of the annular piston 214. In some embodiments, the torsional stiffener mechanism may comprise a track 228 configured to restrain rotational movement of the annular piston 214 with respect to the shaft 202 and the outer sleeve 210 while still permitting axial movement of the annular piston 214 between the first position and the second position. The track 228 may comprise a slot and key configuration. For example, the annular piston 214 may comprise a first key 286 (e.g., protrusion) extending from the radially inner piston surface 254 and a second key 288 (e.g., protrusion) extending from the radially outer piston surface 258. Further, the shaft 202 may comprise a first slot 290, corresponding to the first key 286, that extends axially from at least the first position to the second position, and the outer sleeve 210 may comprise a second slot 292, corresponding to the second key 288, that extends axially from at least the first position to the second position. The annular piston 214 may be configured to move axially along the shaft 202 with the first key 286 disposed in the first slot 290 and the second key 288 disposed in the second slot 292 such that the respective key and slot interfaces restrain rotational movement of the annular piston 214 with respect to the shaft 202 and the outer sleeve 210. In some embodiments, shaft 202 and/or the outer sleeve 210 may comprise additional keys and/or slots may be added.

FIG. 2D illustrates another embodiment of the adjustably flexible downhole tool 150 having a torsional stiffener mechanism 284 configured to increase the torsional stiffness of the adjustably flexible downhole tool 150. The torsional stiffener mechanism 284 may comprise splined surfaces (e.g., a first splined surface 294 and a second splined surface 296) on the shaft 202 and/or the outer sleeve 210, respectively, that are configured to interface with corresponding splined surfaces (e.g., a radially inner splined surface 298 and a radially outer splined surface 201) on the annular piston 214. The splined surfaces may restrain rotational movement of the annular piston 214 with respect to the shaft 202 and the outer sleeve 210 while still permitting axial movement of the annular piston 214. In the illustrated embodiment, each of the shaft 202, the outer sleeve 210, and the annular piston 214 comprise respective splined surfaces. Moreover, as illustrated, the splined surfaces may extend about the circumference of the respective shaft 202, outer sleeve 210, and/or annular piston 214. However, in some embodiments, the splined surfaces may only extend about a portion of the circumference of the respective shaft 202, outer sleeve 210, and/or annular piston 214.

Figure 3A:
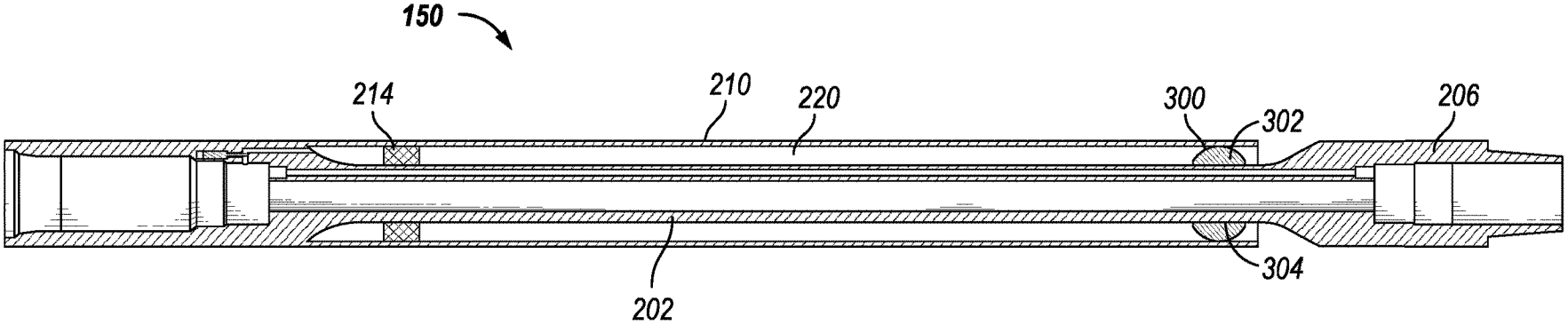
FIG. 3A-3C illustrate a cross-sectional views of an adjustably flexible downhole tool having an annular piston and a pivot guide, in accordance with some embodiments of the present disclosure.
Figure 3B:
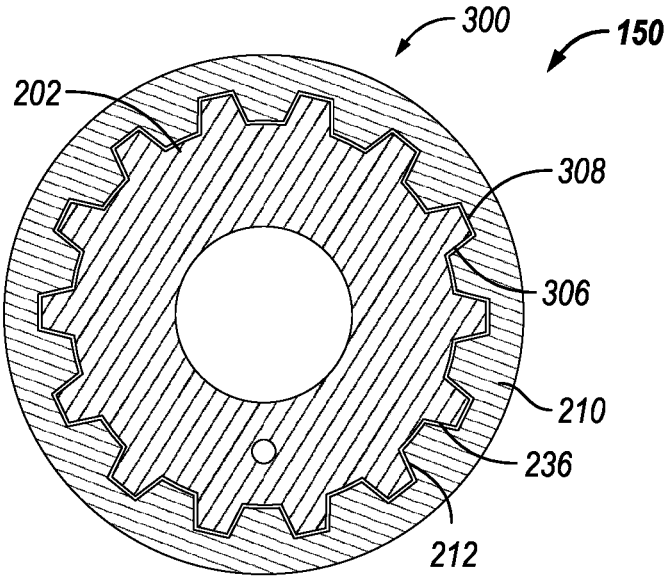
Figure 3C:
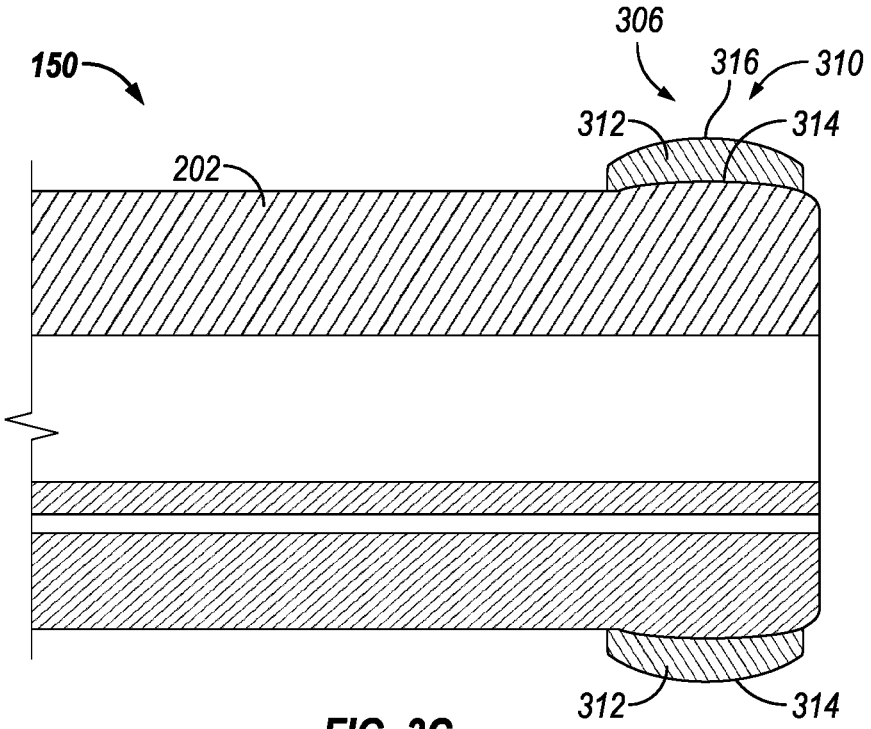

FIGS. 3A-3C illustrate a cross-sectional views of an adjustably flexible downhole tool 150 having an annular piston 214 and a pivot guide 300, in accordance with some embodiments of the present disclosure. As shown in FIG. 3A, the pivot guide 300 may be disposed within the annulus 220 formed between the shaft 202 and the outer sleeve 210 in a location proximate to second connector end 206. The pivot guide 300 may provide radial support between shaft 202 and outer sleeve 210, proximate the second connector end 206, to hold the outer sleeve 210 substantially concentric with the shaft 202 at the location of the pivot guide 300. However, the pivot guide 300 is configured to permit the shaft 202 to bend (e.g., deflect) within the outer sleeve 210 when the adjustable member (e.g., annular piston 214) is in a first position. Indeed, the pivot guide 300 may comprise of a spherical bearing 302 that is allowed to pivot such that the shaft 202 may deflect radially with respect to outer sleeve 210 between annular piston 214 and pivot guide 300. In some embodiments, the pivot guide 300 may comprise a coupling 304 that is configured to pivot to allow radial deflection of shaft 202, but restrains rotational movement between the shaft 202, the pivot guide 300, and the outer sleeve 210 (e.g., torsional coupling). Torsional coupling between the shaft 202, the pivot guide 300, and the outer sleeve 210 may be achieved via threads, splines, or keys, such that the coupling 304 may pivot to allow shaft 202 to deflect radially with respect to outer sleeve 210 between annular piston 214 and pivot guide 300. The coupling 304 may comprise a crowned spline or a constant velocity (CV) joint such as is used in mud motor transmissions. With the torsional coupling, adjustably flexible downhole tool 150 may be configured to achieve a higher torsional stiffness than the shaft 202 alone, while still achieving a variable radial stiffness.

Moreover, the annular piston 214 may be moved on demand, in a direction toward the pivot guide 300, to adjust the adjustably flexible downhole tool 150 to be more radially stiff. Indeed, a variable radial stiffness may be achieved based at least in part on the position of annular piston 214 between first position and pivot guide 300. The adjustably flexible downhole tool 150 may be most stiff position with the annular piston 214 disposed directly adjacent pivot guide 300.

FIG. 3B illustrates an embodiment of the adjustably flexible downhole tool 150 having a pivot guide 300. In the illustrated embodiment, the pivot guide 300 comprises splined pivot surfaces (e.g., a first splined pivot 306 surface and a second splined pivot surface 308). The first splined pivot surface 306 may be formed in the radially outer shaft surface 236 of the shaft 202. Further, the second splined pivot surface 308 may be formed on the radially inner sleeve surface 212 of the outer sleeve 210. During operation, the first splined pivot surface 306 is configured to interface with the second splined pivot surface 308 to restrain rotational movement of the shaft 202 with respect to the outer sleeve 210; thereby, increasing torsional stiffness of the adjustably flexible downhole tool 150. Further, as set forth above, the pivot guide 300 (e.g., the splined pivot surfaces 306, 308) are also configured to provide radial support between shaft 202 and outer sleeve 210, proximate the second connector end 206, to hold the outer sleeve 210 substantially concentric with the shaft 202 at the location of the pivot guide 300 while still permitting the shaft 202 to bend (e.g., deflect) within the outer sleeve 210. Moreover, the splined pivot surfaces 306, 308 may comprise a crowned splines, parallel splines, serrated splines, etc.).

FIG. 3C illustrates an embodiment of the first splined pivot surface 306 of the shaft 202 of the adjustably flexible downhole tool 150. In the illustrated embodiment, the first splined pivot surface 306 comprises a crowned spline 310 having a plurality of teeth 312 and a base surface 314. The plurality of teeth 312 protrude radially outward from the base surface 314. Further, an outer tooth surface 316 of each tooth of the plurality of teeth 312 may be curved or rounded along the axial length of the first splined pivot surface 306. In particular, the outer tooth surface 316 of each tooth may be radiused. Further, the base surface 314 may be curved or rounded along the axial length of the first splined pivot surface 306 such that the shaft 202 may roll or pivot with respect to the outer sleeve 210 at the first splined pivot surface 306. As such, the base surface 314 may be radiused.

Figure 4A:
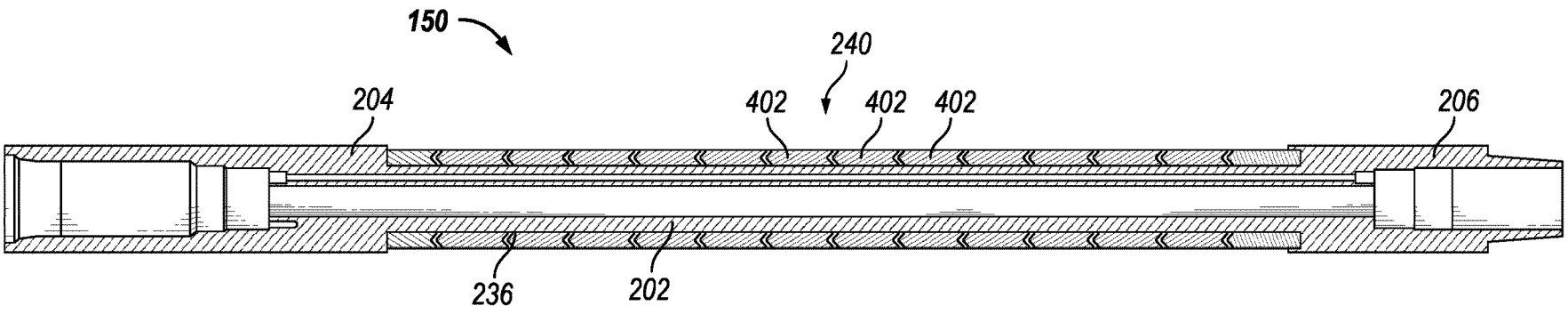
FIGS. 4A & 4B illustrate cross-sectional views of an adjustably flexible downhole tool having a plurality of rings, in accordance with some embodiments of the present disclosure.
Figure 4B:
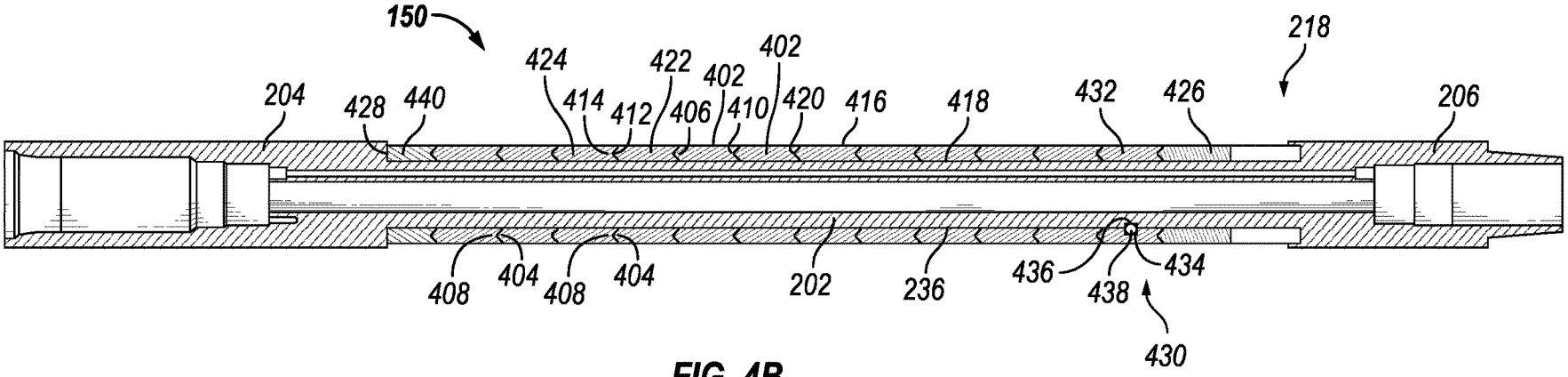

FIGS. 4A & 4B illustrate cross-sectional views of an adjustably flexible downhole tool having a plurality of rings, in accordance with some embodiments of the present disclosure. Referring to FIG. 4A, the adjustably flexible downhole tool 150 comprises the shaft 202 extending between the first connector end 204 and the second connector end 206. Further, the adjustably flexible downhole tool 150 may comprise the at least one adjustable member 240. In the illustrated embodiment, the at least one adjustable member 240 comprises a plurality of annular rings 402 disposed about the radially outer shaft surface 236 of the shaft 202 and along a length of the shaft 202. Each annular ring of the plurality of annular rings 402 is configured to move axially, with respect to the shaft 202, from a respective first position to a respective second position. Moving the plurality of annular rings 402 to the second position may increase bending stiffness and/or torsional stiffness of the adjustably flexible downhole tool 150.

In the illustrated embodiment, each ring of the plurality of annular rings 402 is disposed in a first position such that the adjustably flexible downhole tool 150 is in a flexible configuration. In the first position, each annular ring 402 may be spaced apart from adjacent annular rings 402. Indeed, there may be sufficient axial and/or radial clearance between respective interlocking features of adjacent annular rings of the plurality of annular rings 402 that each annular ring may move radially and/or axially with respect to respective adjacent annular rings. As each annular ring may move freely with respect to adjacent annular rings, the plurality of annular rings 402 may not restrain bending of the shaft 202 such that the adjustably flexible downhole tool 150 may be in the flexible configuration.

Referring to FIG. 4B, the plurality of annular rings 402 are disposed in a second position. As set forth above, each annular ring of the plurality of annular rings 402 is configured to move axially, with respect to the shaft 202, from the respective first position to the respective second position. At the second position, each ring of the plurality of annular rings 402 may axially and/or radially interface with at least one adjacent annular ring to restrain radial movement of the shaft 202 and increase bending stiffness and/or torsional stiffness of the adjustably flexible downhole tool 150. In the illustrated embodiment, each annular ring of the plurality of annular rings 402 comprises a first interlocking feature 404 at a first axial end 406 of the annular ring 402 and a second interlocking feature 408 at a second axial end 410 of the annular ring 402. As illustrated, the first interlocking feature 404 may comprise a protrusion 412 and the second interlocking feature 408 may comprise a recess 414. The protrusion 412 may comprise a chevron shape. That is, the protrusion 412 may be tapered from both the radially outer ring surface 416 and the radially inner ring surface 418 of the first axial end 406 toward a tip 420 of the protrusion 412. The recess 414 may be defined by a corresponding chevron shape. As such that the protrusion 412 of a first annular ring 422 may be inserted into a corresponding recess 414 of an adjacent annular ring (e.g., a second annular ring 424) with the annular rings in the second position. In the second position, the second interlocking feature 408 (e.g., the recess 414) of the second annular ring 424 may interface with the first interlocking feature 404 (e.g., the protrusion 412) of the first annular ring 422 to restrain axial and radial movement of the first and second annular rings with respect to each other. Indeed, with the interlocking features interfaced, the plurality of annular rings may operate as a stiff annular sleeve configured to support the shaft 202, which may increase bending stiffness and/or torsional stiffness of the adjustably flexible downhole tool 150.

As set forth above, the adjustably flexible downhole tool 150 may comprise the actuator 218. The actuator 218 may be configured to drive each annular ring of the plurality of annular rings 402 axially to move from the respective first positions to the respective second positions. In some embodiments, the actuator 218 may comprise a push ring 426 and an electric motor configured to drive the push ring 426 in an axial direction toward the plurality of annular rings 402. The push ring 426 may be disposed about the shaft 202 at an end of the plurality of annular rings 402. In some embodiments, the push ring 426 is threaded to the shaft 202, the first connector end 204, or the second connector end 206 such that driving the push ring 426 in an axial direction comprises rotating/threading the push ring 426. Indeed, the push ring 426 may move axially as it rotates to produce an axial force on the plurality of annular rings 402. The axial force may drive the plurality of annular rings 402 from the respective first positions to the respective second positions. For example, the push ring 426 may be threaded to the second connector end 206 such that the actuator 218 may driving the push ring 426 in a direction toward the first connector end 204. As such, the push ring 426 may drive the plurality of annular rings 402 in a direction toward the first connector end 204 and compress the annular rings 402 against a shoulder 428 of the first connector end 204 and/or a ring adapter 440 disposed between the shoulder 428 and the annular rings 402. Compressing the plurality of annular rings against the first connector end 204 (e.g., moving each of the annular rings 402 from the respective first position to the respective second position) may reduce or remove axial and/or radial clearance between each of the plurality of annular rings 402; thereby, interfacing adjacent interlocking features 404, 408 of the plurality of annular rings 402. Compressing the plurality of annular rings 402 may not require a large amount of axial force.

Moreover, the adjustably flexible downhole tool 150 may comprise a locking feature 430 configured to axially hold the plurality of annular rings 402 in the second position. The locking feature 430 may comprise threading, an expandable locking ring, a collet, a spring energized lock, or any combination thereof. For example, the push ring 426 may be configured to interface with an exterior annular ring 432 of the plurality of annular rings 402 to drive the plurality of annular rings 402 to the second position. The exterior annular ring 432 may comprise a ring slot 434 configured to house an expandable locking ring 438. Further, the shaft 202 may comprise shaft slot 436 disposed in a location corresponding to the second position of the exterior annular ring 432. As the exterior annular ring 432 moves into the second position, the expandable locking ring 438 may expand into the shaft slot 436 and lock the exterior annular ring 432 in the second position. Locking the exterior annular ring 432 in the second position may axially hold the plurality of annular rings 402 in the second position.

Additionally, the adjustably flexible downhole tool 150 may comprise a torsional locking feature to increase torsional stiffness of the adjustably flexible downhole tool 150. The torsional locking feature may restrain rotational movement of the plurality of annular rings 402 with respect to the shaft 202. In some embodiments, the torsional locking feature may comprise a key and slot configuration (shown in FIG. 2C). For example, the shaft 202 may comprise a slot in the radially outer shaft surface 236 that extends along at least a portion of the length of the shaft 202. Further, each annular ring of the plurality of annular rings 402 may comprise a key (e.g., protrusion), corresponding to the slot. The plurality of annular rings 402 may be configured to move axially along the shaft 202 with the key disposed in the respective slots. However, the interface between the key and respective slots may restrain rotational movement of the annular rings 402 with respect to the shaft 202, which may increase the torsional stiffness of the adjustably flexible downhole tool 150. Further, the torsional locking feature may be configured to restrain rotational movement of the plurality of annular rings 402 with respect to each other. In some embodiments, each annular ring 402 may comprise keys, teeth, enhanced frictional surfaces/materials, or other suitable features configured to interface with adjacent annular rings to restrain rotational movement of the plurality of annular rings 402 with respect to each other.

Figure 5A:
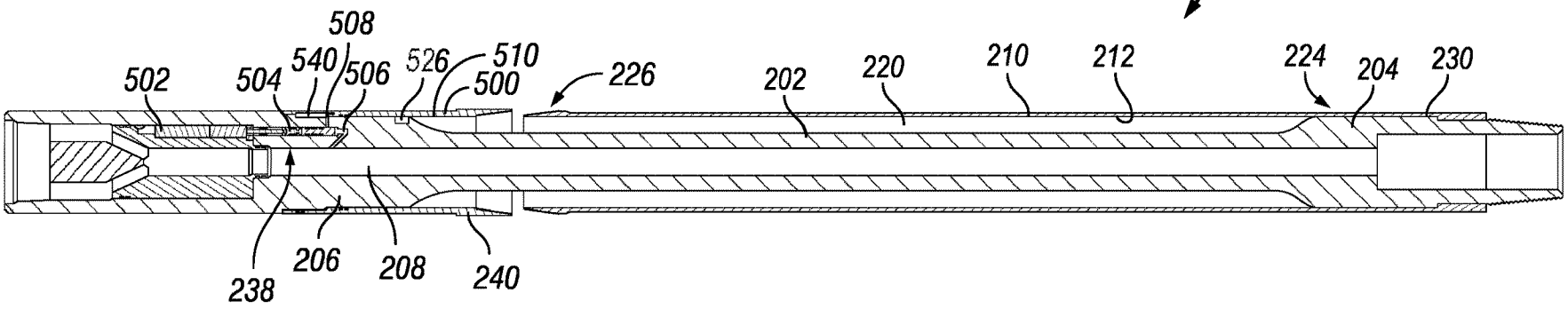
FIGS. 5A & 5B illustrate cross-sectional views of an adjustably flexible downhole tool having an actuating sleeve disposed in a first position and a second position, respectively, in accordance with some embodiments of the present disclosure.
Figure 5B:
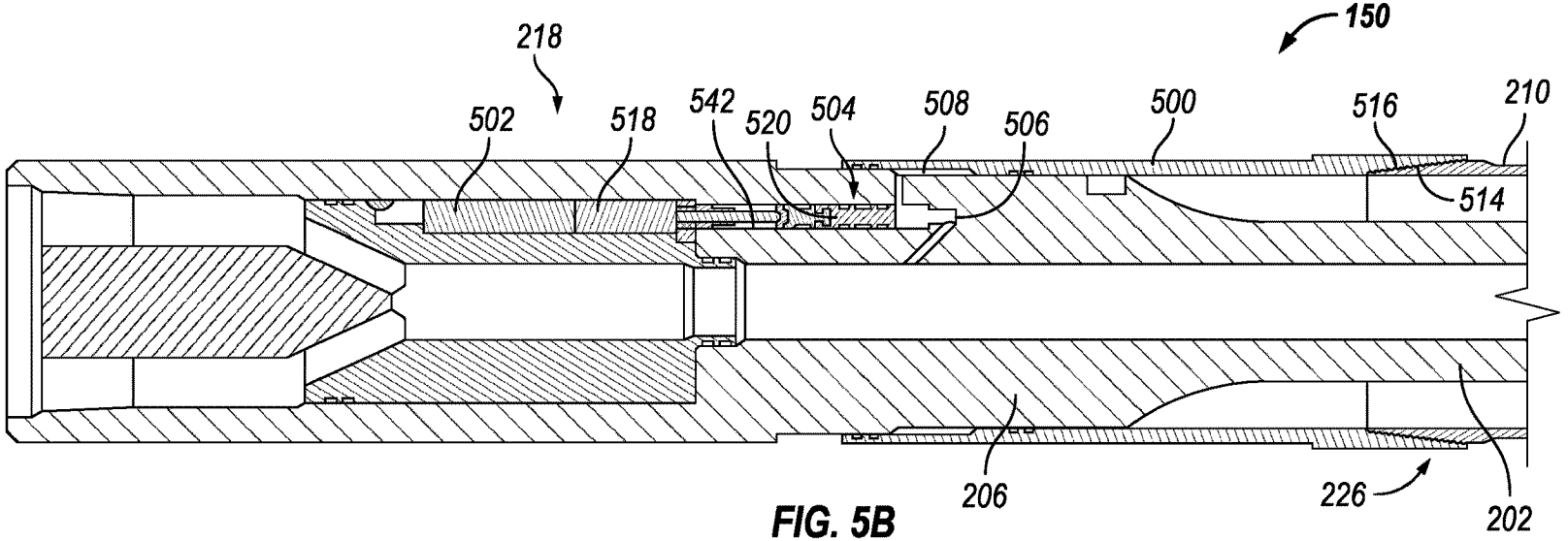

FIGS. 5A & 5B illustrate cross-sectional views of an adjustably flexible downhole tool having an actuating sleeve disposed in a first position and a second position, respectively, in accordance with some embodiments of the present disclosure. Referring to FIG. 5A, the adjustably flexible downhole tool 150 comprises the shaft 202 extending between the first connector end 204 and the second connector end 206. Further, the adjustably flexible downhole tool 150 comprises the outer sleeve 210 disposed around at least a portion of the length of shaft 202. The outer sleeve 210 may be annular such that the outer sleeve radially encloses the shaft 202. Further, the annulus 220 may be formed between the shaft 202 and the outer sleeve 210. That is, the outer sleeve 210 may be radially offset from the shaft 202 such that the shaft 202 may bend (e.g., radially deflect) without contacting the radially inner sleeve surface 212 of the outer sleeve 210. Moreover, as illustrated, the anchored end 224 of the outer sleeve 210 may be connected to the first connector end 204, and the outer sleeve 210 may extend axially from the first connector end 204 in a direction toward the second connector end 206. The free end 226 of the outer sleeve 210, opposite the anchored end 224, may be positioned proximate the second connector end 206. However, as illustrated, the free end 226 is not attached to the second connector end. As such, that the outer sleeve 210 may be cantilevered from the first connector end 204 with the actuating sleeve 500 disposed in the first position. As set forth above, the outer sleeve 210 may be secured to the first connector end 204 via a threaded connection, welding, fasteners (e.g., screws, pins, etc.), and/or press-fitting a radially inner sleeve surface 212 of the outer sleeve 210 against the radially outer connector surface 230 of the first connector end 204.

Further, the adjustably flexible downhole tool 150 may comprise the at least one adjustable member 240. In the illustrated embodiment, the at least one adjustable member 240 comprises the actuating sleeve 500. The actuating sleeve 500 may be coupled to the second connector end 206. Further, the actuating sleeve 500 may be configured to move axially, with respect to the shaft 202, from the first position to the second position to increase bending stiffness and/or torsional stiffness of the adjustably flexible downhole tool 150. As illustrated, in the first position, the actuating sleeve 500 is axially offset from the outer sleeve 210 such that the outer sleeve 210 may not support the shaft 202 in the first position. Therefore, adjustably flexible downhole tool 150 may be in a flexible configured with the actuating sleeve 500 in the first position, such that the rotary steerable system 130 may bend sufficiently to achieve a high dog leg severity through curved portions 156 of the wellbore 102. However, in the second position (shown in FIG. 5B), the actuating sleeve 500 is configured to interface with the outer sleeve 210 to restrain radial movement (e.g., bending) of the shaft 202 with respect to the outer sleeve 210.

Moreover, the adjustably flexible downhole tool 150 may comprise the actuator 218 to drive the actuating sleeve 500 from the first position to the second position. The actuator 218 may comprise a hydraulic actuator, an electric motor, or some combination thereof. In the illustrated embodiment, the actuator 218 comprises a hydraulic system 238 having an electric motor 502 configured to actuate a piston valve 504 to open a fluid line 506 from the central bore 208 to a sealed chamber 508. The sealed chamber 508 may be defined by a radially inner actuating surface 510 of the actuating sleeve 500 and a second radially outer connector surface 540 of the second connector end 206. Further, opening the fluid line 506 may permit fluid passing through the central bore 208 to flow into the sealed chamber 508, which may increase the pressure in the sealed chamber 508. In some embodiments, a shear pin 526 may be configured to hold the actuating sleeve 500 in the first position. The shear pin 526 may be configured to shear in response to a threshold axial force (e.g., an actuation force) applied to the actuating sleeve 500 such that the actuating sleeve 500 may move from the first position towards the second position to interface with the outer sleeve 210. Once the piston valve 504 opens the fluid line 506, the pressure in the sealed chamber 508 may increase sufficiently to apply the threshold axial force to the actuating sleeve 500 such that the actuating sleeve 500 may move from the first position to the second position.

Referring to FIG. 5B, the actuating sleeve 500 is disposed in the second position. In the second position, the actuating sleeve 500 is interfaced with the outer sleeve 210 to restrain radial movement (e.g., bending) of the shaft 202. Interfacing the actuating sleeve 500 with the outer sleeve 210 may rigidly connect the outer sleeve 210 with the second connector end 206 such that the outer sleeve 210 is supported at both the anchored end 224 (shown in FIG. 5A) and the free end 226. Connecting the outer sleeve 210 at both ends may increase the bending stiffness and/or torsional stiffness of the adjustably flexible downhole tool 150.

The free end 226 of the outer sleeve 210 may comprise a first interface surface 514 configured to interface with a second interface surface 516 of the actuating sleeve 500. In the illustrated embodiment, the first interface surface 514 and the second interface surface 516 comprise tapered/angular surfaces. However, the first interface surface 514 and the second interface surface 516 may comprise any suitable interface for restraining radial and/or axial movement of the free end 226 of the outer sleeve 210. For example, the first interface surface 514 may comprise at least one protrusion and the second interface surface 516 may comprise at least one recess configured to receive the at least one protrusion.

As set forth above with respect to FIG. 5A, the adjustably flexible downhole tool 150 may comprise the actuator 218 to move the actuating sleeve 500 from the first position to the second position. In the illustrated embodiment, the actuator 218 may comprise the electric motor 502 attached to a ball-screw mechanism 518. The electric motor 502, ball-screw mechanism 518, and an associated power supply and electronics may be installed in the second connector end 206. The electric motor 502 may drive ball-screw mechanism 518 to actuate the piston valve 504 (e.g., move a piston plug 520 along the piston valve housing 542) which may open the fluid line 506 to the sealed chamber 508. After pressure in the sealed chamber 508 increased above a threshold pressure (e.g., wellbore pressure), a pressure differential between the sealed chamber 508 and the wellbore 102 may drive the actuating sleeve 500 to move to the second position.

In some embodiments, the actuator 218 may comprise the electric motor 502 attached to a hydraulic pump (not shown) that is configured to pump hydraulic oil from a reservoir into the sealed chamber 508. The pressure from the hydraulic oil pumped into the sealed chamber may drive the actuating sleeve 500 to the second position. Further, the pressure in sealed chamber 508 may be controlled with a check valve/relief valve. A pressure transducer may monitor the pressure in sealed chamber 508. In response to the pressure in the sealed chamber 508 falling lower than desired pressure, the electric motor 502 and hydraulic pump may be pump additional hydraulic oil into the sealed chamber 508 to restore the desired pressure to sealed chamber 508. In response to pressure in the sealed chamber 508 exceeding a maximum desire pressure (e.g., due to thermal expansion of the hydraulic oil or from compression of sealed chamber 508 due to mechanical loading), the relief valve may vent a portion of the hydraulic oil back to the reservoir, which may reduce pressure in the sealed chamber 508.

Moreover, the actuator 218 may be configured to drive the actuating sleeve 500 from the second position back to the first position. For example, a solenoid valve (not shown) may open to allow the hydraulic oil in the sealed chamber 508 to vent back to the reservoir. Further, the actuator 218 may comprise a biasing mechanism (not shown). The biasing mechanism may comprise a spring configured to apply a biasing force to the actuating sleeve 500 in a direction toward the first position. As the pressure in the sealed chamber 508 decreases, via the oil being vented, the actuation force on the actuating sleeve 500 from pressure in the sealed chamber may fall below the biasing force from the biasing spring, such that the biasing spring may drive the actuating sleeve 500 from the second position to the first position. As such, the actuator may selectively move the actuating sleeve between the first position and the second position to adjust the bending stiffness and/or torsional stiffness of the adjustably flexible downhole tool 150.

Figure 6:
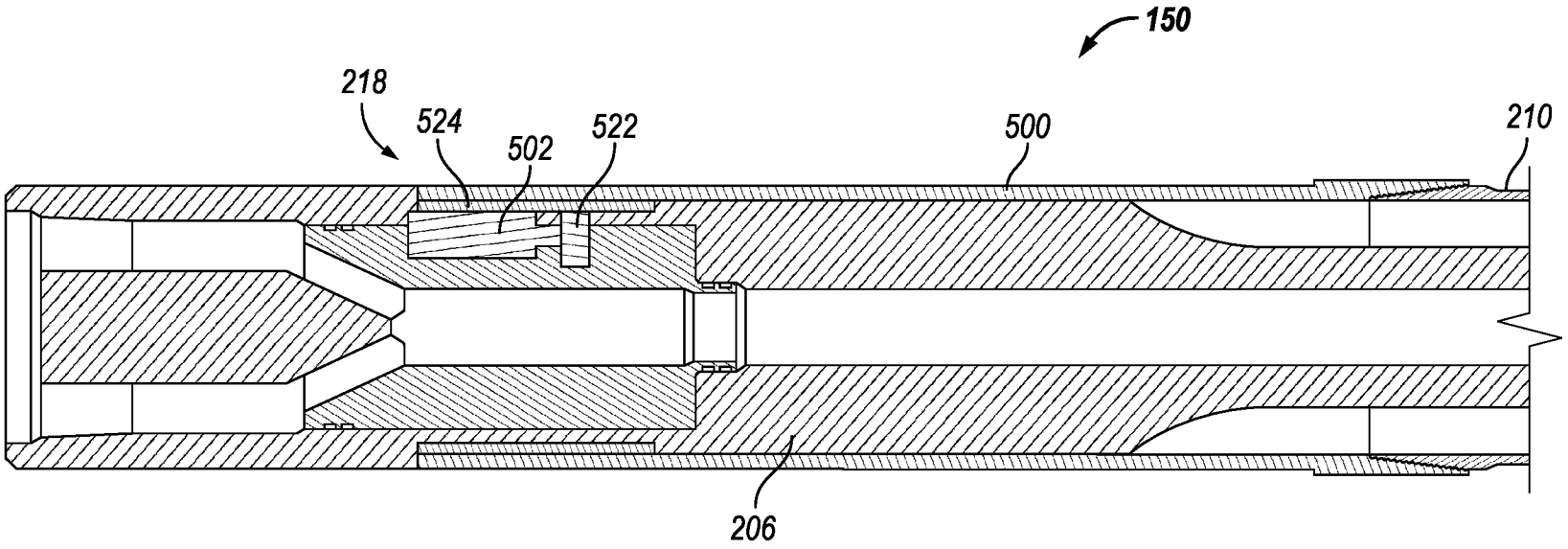
FIG. 6 illustrates a cross-sectional view of an adjustably flexible downhole tool having a mechanical actuator configured to drive the sleeve from the first position to the second position, in accordance with some embodiments of the present disclosure.

FIG. 6 illustrates a cross-sectional view of an adjustably flexible downhole tool having a mechanical actuator configured to drive the actuating sleeve from the first position to the second position, in accordance with some embodiments of the present disclosure. As illustrated, the adjustably flexible downhole tool 150 may comprise the actuator 218 to drive the actuating sleeve 500 from the first position to the second position. The actuator 218 may comprise an electric motor 502 configured to drive a pinion gear 522 to rotate the actuating sleeve 500 via a ring gear/spline 524 such that the actuating sleeve 500 moves axially from the first position to the second position. In some embodiments, the actuating sleeve 500 may be threaded to the second connector end 206 of the adjustably flexible downhole tool 150. As such, moving the actuating sleeve 500 may comprise rotating the actuating sleeve 500 with respect to the second connector end 206. In some embodiments, the electric motor may be configured to drive the actuating sleeve 500 into the outer sleeve 210 with high axial force to generate an effective coupling of the actuating sleeve 500 to the outer sleeve 210 that resists separation under bending moments and/or other forces applied to the adjustably flexible downhole tool 150. The high axial force may also resist deformation (e.g., ovalization) of the actuating sleeve 500 and the outer sleeve 210 in response to bending.

Moreover, as set forth above, the actuator 218 may be configured to drive the actuating sleeve 500 from the second position to the first position. In some embodiments, the electric motor 502 may operate in the reverse direction to move actuating sleeve 500 away from the outer sleeve 210 and back to the first position. As such, the actuator 218 may selectively move the actuating sleeve 500 between the first position and the second position to adjust the bending stiffness and/or torsional stiffness of the adjustably flexible downhole tool 150. Indeed, the actuator 218 may alternate the actuating sleeve 500 between the first position and the second position as the bottom hole assembly 134 moves along the wellbore 102 based at least in part on a portion of the wellbore (e.g., straight portion or curved portion) through which the bottom hole assembly 134 is traveling.

Accordingly, the present disclosure may provide systems for adjusting bending stiffness and/or torsional stiffness of an adjustably flexible downhole tool as the bottom hole assembly moves through a wellbore. The claim may comprise any of the various features disclosed herein, including one or more of the following statements.

Statement 1. A system for an adjustably flexible downhole tool comprises first and second connector ends; a shaft extending between the first and second connector ends, wherein the shaft is configured to bend in response to passing through curved portions of a wellbore; an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position.

Statement 2. The system of statement 1, wherein the at least one adjustable member is disposed within an annulus formed between a radially outer surface of the shaft and a radially inner surface of the outer sleeve.

Statement 3. The system of statement 1 or statement 2, wherein the first position is disposed proximate the first connector end, and wherein the second position is disposed proximate the second connector end.

Statement 4. The system of any preceding statement, wherein the at least one adjustable member comprises an annular piston, wherein a radially inner piston surface of the annular piston interfaces with a radially outer shaft surface of the shaft and a radially outer piston surface of the annular piston interfaces with a radially inner sleeve surface of the outer sleeve, and wherein the annular piston at least partially restrains radial movement of the shaft with respect to the outer sleeve at a location of the annular piston.

Statement 5. The system of any preceding statement, further comprising a track disposed along a path of the at least one adjustable member from the first position to the second position, wherein the track is configured restrain rotational movement of the at least one adjustable member with respect to the shaft and the outer sleeve.

Statement 6. The system of any preceding statement, further comprising a debris barrier spanning between the shaft and the outer sleeve, wherein the debris barrier is configured to prevent downhole debris from moving into an annulus formed between the shaft and the outer sleeve.

Statement 7. The system of any preceding statement, further comprising a wedge disposed proximate the second position, wherein the wedge is configured to secure the at least one adjustable member at the second position.

Statement 8. The system of any preceding statement, further comprising a pivot guide disposed about the shaft proximate the second connector end, wherein the pivot guide is disposed between the shaft and the outer sleeve, and wherein the pivot guide comprises a spherical bearing, a crowned spline, or other constant velocity joint configured to pivot such that the shaft may radially deflect with respect to the outer sleeve.

Statement 9. The system of any of statements 1, 3, 5, or 6, wherein the at least one adjustable member comprises an actuating sleeve that is axially offset from the outer sleeve in the first position, and wherein the actuating sleeve is configured to interface with the outer sleeve to restrain bending of the shaft in the second position.

Statement 10. The system of statement 1 or statement 3, wherein the at least one adjustable member comprises a plurality of annular rings, wherein each annular ring of the plurality of annular rings is configured to interface with at least one adjacent annular ring, in the second position, to restrain bending of the shaft in the second position.

Statement 11. The system of any preceding statement, further comprising an actuator configured to drive the adjustable member to any position between the first position and the second position, wherein the actuator may be configured to drive the adjustable member forward toward the first position and/or in reverse toward the second position, and wherein the actuator comprises a hydraulic actuator, an electric motor, or some combination thereof.

Statement 12. A system for an adjustably flexible downhole tool comprises first and second connector ends; a shaft extending between the first and second connector ends, wherein the shaft is configured to bend in response to passing through curved portions of a wellbore; and a plurality of annular rings disposed about a radially outer surface of the shaft along a length of the shaft, wherein each annular ring of the plurality of annular rings is configured to move axially, with respect to the shaft, from a first position to a second position, and wherein each annular ring of the plurality of annular rings is configured to interface with at least one adjacent annular ring, in the second position, to at least partially restrain bending of the shaft and increase bending stiffness and/or torsional stiffness of the adjustably flexible downhole tool.

Statement 13. The system of statement 12, wherein each annular ring of the plurality of annular rings comprises a first interlocking feature at a first axial end of the annular ring and a second interlocking feature at a second axial end of the annular ring, wherein the first interlocking feature comprises a protrusion, and wherein the second interlocking feature comprises a recess.

Statement 14. The system of statement 12 or statement 13, further comprising a locking feature configured to axially hold the plurality of annular rings in the second position.

Statement 15. The system of any of statements 12-14, wherein the locking feature comprises threading, an expandable ring, a spring energized lock, collet, or some combination thereof.

Statement 16. The system of any of statements 12-15, further comprising a torsional locking feature configured to restrain rotational movement of the plurality of annular rings with respect to the shaft.

Statement 17. The system of any of statements 12-16, further comprising an actuator configured to drive the plurality of annular rings axially, with respect to the shaft, from the first position to the second position such that the plurality of annular rings are compressed toward each other.

Statement 18. A system for an adjustably flexible downhole tool comprises first and second connector ends; a shaft extending between the first and second connector ends, wherein the shaft is configured to bend in response to passing through curved portions of a wellbore; an outer sleeve disposed around at least a portion of the shaft and extending from the first connector end in a direction toward the second connector end; and an actuating sleeve coupled to the second connector end, wherein the actuating sleeve is configured to move axially, with respect to the shaft, from a first position to a second position, and wherein the actuating sleeve in configured to interface with outer sleeve in the second position to restrain bending of the shaft and increase bending stiffness and/or torsional stiffness of the adjustably flexible downhole tool.

Statement 19. The system of statement 18, further comprising a shear pin configured to hold the actuating sleeve in the first position, wherein the shear pin is configured to shear to release the actuating sleeve in response to an actuation force.

Statement 20. The system of statement 18 or statement 19, further comprising an actuator configured to drive the actuating sleeve from the first position to the second position, wherein the actuator comprises a hydraulic actuator, an electric motor, or some combination thereof.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially along the shaft from a first position to a second position to increase bending stiffness and/or torsional stiffness of the adjustably flexible downhole tool, wherein the at least one adjustable member at least partially restrains bending of the shaft in the second position.

2. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, and wherein the at least one adjustable member is disposed within an annulus formed between a radially outer surface of the shaft and a radially inner surface of the outer sleeve.

3. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, and wherein the first position is disposed proximate the first connector end, and wherein the second position is disposed proximate the second connector end.

4. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, wherein the at least one adjustable member comprises an annular piston, wherein a radially inner piston surface of the annular piston interfaces with a radially outer shaft surface of the shaft and a radially outer piston surface of the annular piston interfaces with a radially inner sleeve surface of the outer sleeve, and wherein the annular piston at least partially restrains radial movement of the shaft with respect to the outer sleeve at a location of the annular piston.

5. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end;

at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position; and a track disposed along a path of the at least one adjustable member from the first position to the second position, wherein the track is configured restrain rotational movement of the at least one adjustable member with respect to the shaft and the outer sleeve.

6. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end;

at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position; and a debris barrier spanning between the shaft and the outer sleeve, wherein the debris barrier is configured to prevent downhole debris from moving into an annulus formed between the shaft and the outer sleeve.

7. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end;

at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position; and a wedge disposed proximate the second position, wherein the wedge is configured to secure the at least one adjustable member at the second position.

8. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end;

at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, and a pivot guide disposed about the shaft proximate the second connector end, wherein the pivot guide is disposed between the shaft and the outer sleeve, and wherein the pivot guide comprises a spherical bearing, a crowned spline, or other constant velocity joint configured to pivot such that the shaft may radially deflect with respect to the outer sleeve.

9. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, wherein the at least one adjustable member comprises an actuating sleeve that is axially offset from the outer sleeve in the first position, and wherein the actuating sleeve is configured to interface with the outer sleeve to restrain bending of the shaft in the second position.

10. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, and wherein the at least one adjustable member comprises a plurality of annular rings, wherein each annular ring of the plurality of annular rings is configured to interface with at least one adjacent annular ring, in the second position, to restrain bending of the shaft in the second position.

11. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end;

at least one adjustable member configured to move axially, with respect to the shaft, from a first position to a second position to increase bending stiffness and/or torsional stiffness of the adjustably flexible downhole tool, wherein the at least one adjustable member at least partially restrains bending of the shaft in the second position, and an actuator configured to drive the adjustable member to any position between the first position and the second position, wherein the actuator may be configured to drive the adjustable member forward toward the first position and/or in reverse toward the second position, and wherein the actuator comprises a hydraulic actuator, an electric motor, or some combination thereof.

12. A system for an adjustably flexible downhole tool, comprising:

first and second connector ends;

a shaft extending between the first and second connector ends, wherein the shaft is configured to bend in response to passing through curved portions of a wellbore; and a plurality of annular rings disposed about a radially outer surface of the shaft along a length of the shaft, wherein each annular ring of the plurality of annular rings is configured to move axially, with respect to the shaft, from a first position to a second position, and wherein each annular ring of the plurality of annular rings is configured to interface with at least one adjacent annular ring, in the second position, to at least partially restrain bending of the shaft and increase bending stiffness and/or torsional stiffness of the adjustably flexible downhole tool.

13. The system of claim 12, wherein each annular ring of the plurality of annular rings comprises a first interlocking feature at a first axial end of the annular ring and a second interlocking feature at a second axial end of the annular ring, wherein the first interlocking feature comprises a protrusion, and wherein the second interlocking feature comprises a recess.

14. The system of claim 12, further comprising a locking feature configured to axially hold the plurality of annular rings in the second position.

15. The system of claim 14, wherein the locking feature comprises threading, an expandable ring, a spring energized lock, collet, or some combination thereof.

16. The system of claim 12, further comprising a torsional locking feature configured to restrain rotational movement of the plurality of annular rings with respect to the shaft.

17. The system of claim 12, further comprising an actuator configured to drive the plurality of annular rings axially, with respect to the shaft, from the first position to the second position such that the plurality of annular rings are compressed toward each other.

18. A system for an adjustably flexible downhole tool, comprising:

first and second connector ends;

a shaft extending between the first and second connector ends, wherein the shaft is configured to bend in response to passing through curved portions of a wellbore;

an outer sleeve disposed around at least a portion of the shaft and extending from the first connector end in a direction toward the second connector end; and an actuating sleeve coupled to the second connector end, wherein the actuating sleeve is configured to move axially, with respect to the shaft, from a first position to a second position, and wherein the actuating sleeve in configured to interface with outer sleeve in the second position to restrain bending of the shaft and increase bending stiffness and/or torsional stiffness of the adjustably flexible downhole tool.

19. The system of claim 18, further comprising a shear pin configured to hold the actuating sleeve in the first position, wherein the shear pin is configured to shear to release the actuating sleeve in response to an actuation force.

20. The system of claim 18, further comprising an actuator configured to drive the actuating sleeve from the first position to the second position, wherein the actuator comprises a hydraulic actuator, an electric motor, or some combination thereof.

* * * * *